United States Patent [19]

Kondo et al.

[11] Patent Number: 4,926,738

[45] Date of Patent: May 22, 1990

[54] ELECTRONIC RHYTHM PERFORMING APPARATUS GENERATING BOTH MANUAL AND AUTOMATIC RHYTHM TONES

[75] Inventors: Masao Kondo; Yasunao Abe, both of Hamamatsu, Japan

[73] Assignee: Yamaha Corporation, Hamamatsu, Japan

[21] Appl. No.: 293,219

[22] Filed: Jan. 4, 1989

[30] Foreign Application Priority Data

Jan. 6, 1988 [JP] Japan ..... 63-1082

[51] Int. Cl.[5] ..... G10H 1/22; G10H 1/42; G10H 7/00

[52] U.S. Cl. ..... 84/618; 84/635; 84/DIG. 2; 84/DIG. 12

[58] Field of Search ..... 84/1.03, DIG. 2, DIG. 12, 84/634–638, 666–669, 712–717, 618, 656, 684

[56] References Cited

U.S. PATENT DOCUMENTS 4,299,154 11/1981 Dietrich et al. ..... 84/1.03
4,628,788 12/1986 Shibukawa ..... 84/103

FOREIGN PATENT DOCUMENTS 62-2099 1/1987 Japan .
62-92997 4/1987 Japan .

*Primary Examiner*—Stanley J. Witkowski
*Attorney, Agent, or Firm*—Spensley Horn Jubas & Lubitz

[57] ABSTRACT

The present invention relates to an electronic rhythm performing apparatus which can generate both automatic rhythm sounds and manual rhythm sounds. In particular, the present invention relates to an apparatus which allows an operator to temporarily stop the generation of automatic rhythm, tones or to reduce the volume of automatic rhythm, tones at a predetermined point in the music; and to later produce a manual rhythm sound as the indication that the automatic rhythm sound should be resumed.

14 Claims, 5 Drawing Sheets

ELECTRONIC RHYTHM PERFORMING APPARATUS GENERATING BOTH MANUAL AND AUTOMATIC RHYTHM TONES

BACKGROUND OF THE INVENTION

The present invention relates to an electronic apparatus for the performance of rhythm, which can generate automatic rhythm sounds as well as produce rhythm sounds manually, and which can in particular control the initiation and cessation of the automatic rhythm sounds by detecting the production of manual rhythm.

In electronic musical instruments with the capability to perform rhythm sounds automatically, the conventional means of changing from the manual mode of rhythm production to the automatic mode of rhythm production, and vice-versa, is either to use a switch on a keyboard (as for example in the use of a mode selection controller which includes a "hand percussion mode", cf. Japanese Utility Model Application laid open No. 62-2099), or to use a switch located on or in close proximity to the instrument.

Although it is possible in these instruments of the conventional means for the operator to select whether rhythm is produced manually or automatically, it requires the operator to pause and to use a switch in order to change from one mode of operation to the other.

SUMMARY OF THE INVENTION

In rhythm sound instruments of the conventional means, the operator is required to select whether rhythm is produced manually or automatically by pausing to use a switch. This pause is inconvenient for the performer and is not desirable. One possible solution to this problem is for the operator to use a percussion controller which can cause the automatic rhythm sound to stop during a pause in the music and also to resume the automatic rhythm using said percussion controller when the pause is ended. If the controller is causing the rhythm sound to pause at a certain point in the performance, the invention makes it possible to generate a manual sound so as to indicate the end of the pause by inhibiting the transition from one pause interval to another pause interval.

It is therefore an object of the present invention to provide an apparatus for the generation of manual rhythm sounds which can signify the end of a pause. The rhythm performance apparatus of the present invention comprises a clock generator to produce a tempo clock signal; a data generator to produce sound control data based on said tempo clock signal and the desired rhythm pattern; a sound source to produce an automatic rhythm sound signal; a sound source controller to direct the action of a break; a breaker to periodically stop the production of the automatic rhythm sound signal; a break inhibitor to prevent the transition from one pause interval to another; and a time measuring means to clock the duration of the pause.

DESCRIPTION OF THE PREFERRED EMBODIMENT

The rhythm performance apparatus of the present invention comprises a clock generator to produce a tempo clock signal; a data generator to produce sound control data based on said tempo clock signal and the desired rhythm pattern; a sound source to produce an automatic rhythm sound signal; a sound source controller to direct the action of a breaker; a breaker to periodically stop the production of the automatic rhythm sound signal; a break inhibitor to prevent the transition from one pause interval to another; and a time measuring means to clock the duration of the pause.

In the operation of the present invention, the automatic rhythm sound remains in the pause-state under the direction of the controller until a point in the performance, such as the end of a bar. A manual rhythm can be performed by operating the sound production controller during the pause. In addition, the transition to another break is inhibited for a predetermined interval, and so a manual rhythm sound can be generated to signify the end of a pause and the resumption of the automatic rhythm sound.

Figure 1:
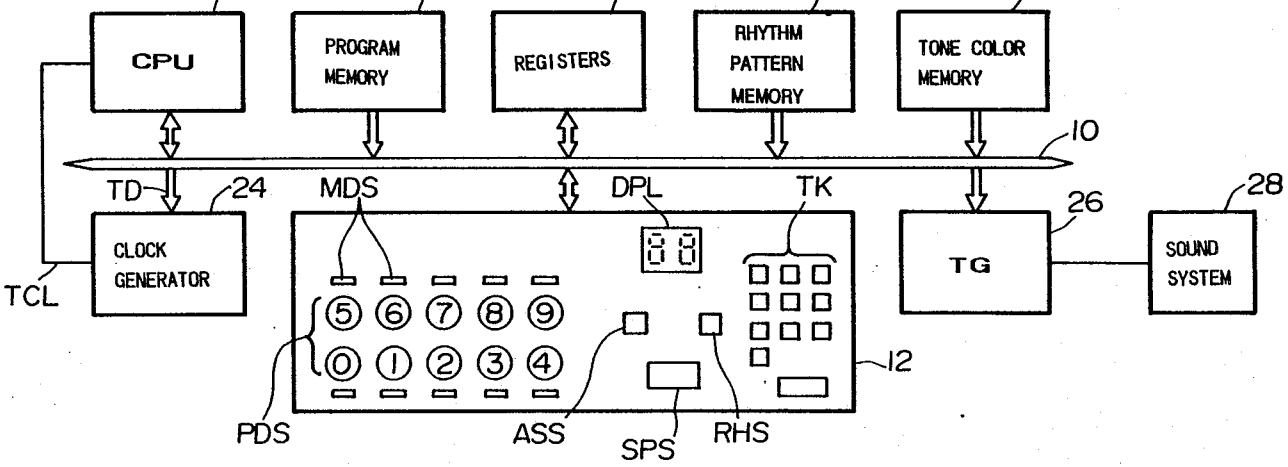
FIG. 1 is a block diagram showing an arrangement of the panel 12 and a schematic diagram of the electronic elements of the apparatus for rhythm performance of the present invention.

FIG. 1 illustrates the configuration of the rhythm performing means of the present invention. The generation of automatic and manual rhythm sounds is controlled by a microcomputer contained in the rhythm performing means. Data Bus 10 is connected to Panel 12, CPU 14, Program Memory 16, Registers 18, Rhythm Pattern Memory 20, Tone Memory 22, Clock Generator 24, and Tone Generator (TG) 26.

The following controllers in this example are installed in Panel 12: Numeric Key TK, which consists of ten numeric keys from digit 0 to 9; Rhythm Selection Switch RHS; Pad Controllers PDS from digit 0 to 9; Mode Selection Switch MDS, which has three contact points responding to each of the 10 PDSs; Assignment Switch ASS; and Start/Stop Switch SPS. Other controllers such as the tempo adjuster and the volume controller are also installed on Panel 12. Near Numeric Key TK is Display DPL which is designed to display the last two figures of a number designated by Numeric Key TK. Numeric Key TK is used to select a desired rhythm pattern as well as to assign a desired tone to a desired pad control element and a rhythm sound source channel which responds to it.

In selecting a desired rhythm pattern, as for example a march, the operator depresses the Numeric Key TK which corresponds to the desired rhythm pattern, and then switches the Rhythm Selection Switch RHS to the "ON" position when the Display DPL shows the last two digits of the rhythm pattern number.

In order to provide the desired tone color, such as the tone of a bass drum, the operator depresses the digit of the Numeric Key TK and at the same time switches the pad controller and the Assignment Switch ASS while Display DPL shows the last two digits of the tone number. In this case, the same tone is provided to the rhythm sound source channel which responds to the pad controller of the tone assignment. Mode selection switch MDS allows the selection of modes from 0 to 2 for each pad controller. Mode 0 is the nominal mode which allows the performance of rhythm manually according to pad operation. Mode 1 is a pause mode which, in addition to the functions of Mode 0, has the added function to cause the automatic rhythm to pause during the period from the moment of pad operation until the end of a bar, for example. Mode 2 is a pause inhibition mode which, in addition to the functions of Mode 1, has the additional function of inhibiting the transition to a pause for a predetermined interval.

The CPU 14 carries out various kinds of information processing for the generation of rhythm sounds using programs stored in Program Memory 16. The processing is discussed further in the specifications for FIGS. 3 and 6.

The Registers 18 consist of various registers which are used for processing by CPU 14:

(1) Key Data Register DATA stores key data which are represented by the last two digits of the number designated on Numeric Keys TK;

(2)Rhythm Number Register RHY stores the rhythm number selected by Rhythm Selection Switch RHS;

(3) Run Flag is a 1-bit register in which "1" indicates the operation of automatic rhythm, and "0" indicates the automatic rhythm is not in operation;

(4) Clock Counter CLK repeatedly counts from bar to bar the number of Tempo Clock Signals TCL which are generated by Clock Generator 24, and this count can vary from 0 to 32 within a single bar, the Clock Counter CLK being reset to 0 when the count value reaches 32;

(5) Mode Register Modes 0 through 9 correspond to the ten Mode Selection Switches MDSs 0 through 9, respectively, and the Mode Register MODE stores the mode number (1, 2, or 3) which is designated by the mode-selection register;

(6) Break Flag BRK is a 1-bit register in which a "1" indicates a pause state, and a "0" indicates a non-pause state;

(7) Break Enabling Flag TBRK is a 1-bit register in which a "1" indicates the break is enabled, and a "0" indicates the break is not enabled;

(8) Brake Inhibiting Flag DBRK is a 1-bit register in which a "1" indicates the break is inhibited, and a "0" indicates the break is not inhibited;

(9) Tone Number Register Pad 0 through 9 stores a rhythm tone number which is assigned to the Pad Controllers PDSs 0 through 9 which correspond to the Tone Number Registers 0 through 9, respectively.

The Rhythm Pattern Memory 20 stores various rhythm patterns of for example a waltz, a march, and a rumba. Each of the rhythm patterns consists of the sound production control data for a bar. Automatic rhythm performance is carried out by reading the rhythm pattern for the selected rhythm in accordance with Tempo Clock Signal TCL.

Tone Memory 22 stores the tone control data which are fed to the rhythm sound source channels depending upon rhythm tone numbers.

Clock Generator 24 generates Tempo Clock Signal TCL in a frequency which is equivalent to the tempo specified by the tempo adjuster in accordance with Tempo Data DCL. Each clock pulse of Tempo Clock Signal TCL is used to start the clock interruption routine of FIG. 6.

Tone Generator TG 26 has ten rhythm sound source channels that respond to Pad Controller PDS0 through PDS9, respectively, and it can generate the rhythm sound signal which is assigned to each channel.

The timing of the rhythm sound signal generation is determined by the read-out of sound production command of the rhythm pattern and/or the operation of the pad controller.

Sound System 28 consists of a power amplifier, speakers, and other components, and the system converts the rhythm sound signal generated by TG 26 into audible sound.

Figure 2:
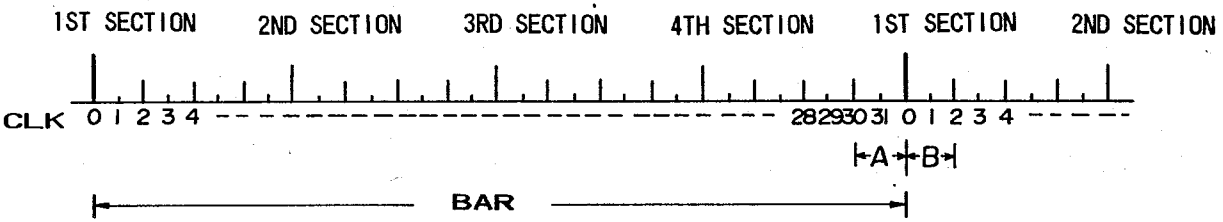
FIG. 2 is a time-flow diagram which shows clock timing in relation to bars and beats.

Operations during a pause after a break and the inhibition of the break is shown in relation to the clock timing of bars and beats in FIG. 2. The CLK in FIG. 2 represents the count value of Clock Counter CLK at the moment when the clock interruption routine in FIG. 6 begins. By operating the pad controller of Mode 1 before CLK=30 in a bar, the manual rhythm sound will be generated accordingly. The automatic rhythm performance will break from the moment of this operation until the end of the following bar. By operating the Mode 1 pad controller during the period from CLK=30 until CLK=0 (which is the equivalent of a quarter beat shown as "A" in FIG. 2), the automatic rhythm performance will break from the beginning of the following bar until the end of that bar.

In either of the cases mentioned above, manual rhythm performance is possible during the pause in the automatic rhythm performance. In addition, the following bar will break if the Mode 1 pad controller is operated while it is still in the previous bar in which the automatic rhythm performance was in a pause state. The operation of the Mode 2 pad controller, in a bar will cause the automatic rhythm performance to break until the end of the bar or the following bar, and manual rhythm performance is possible during the period of the break of the automatic rhythm performance.

In contrast to the case of the Mode 1 pad controller, however, the automatic rhythm performance will not break in the next bar by operating the Mode 2 pad controller in the bar previous to that in which the automatic rhythm performance breaks.

By operating the Mode 2 pad controller during the period which is equivalent to a quarter beat immediately after the bar of the automatic rhythm performance break (in other words, the first quarter beat of the following bar in which the automatic rhythm performance will resume is shown in FIG. 2 labeled "B"), the manual rhythm performance will be generated accordingly. The automatic rhythm will not break, so the manual rhythm performance can be generated to signify the end of the pause shown as "B" in FIG. 2.

Figure 3:
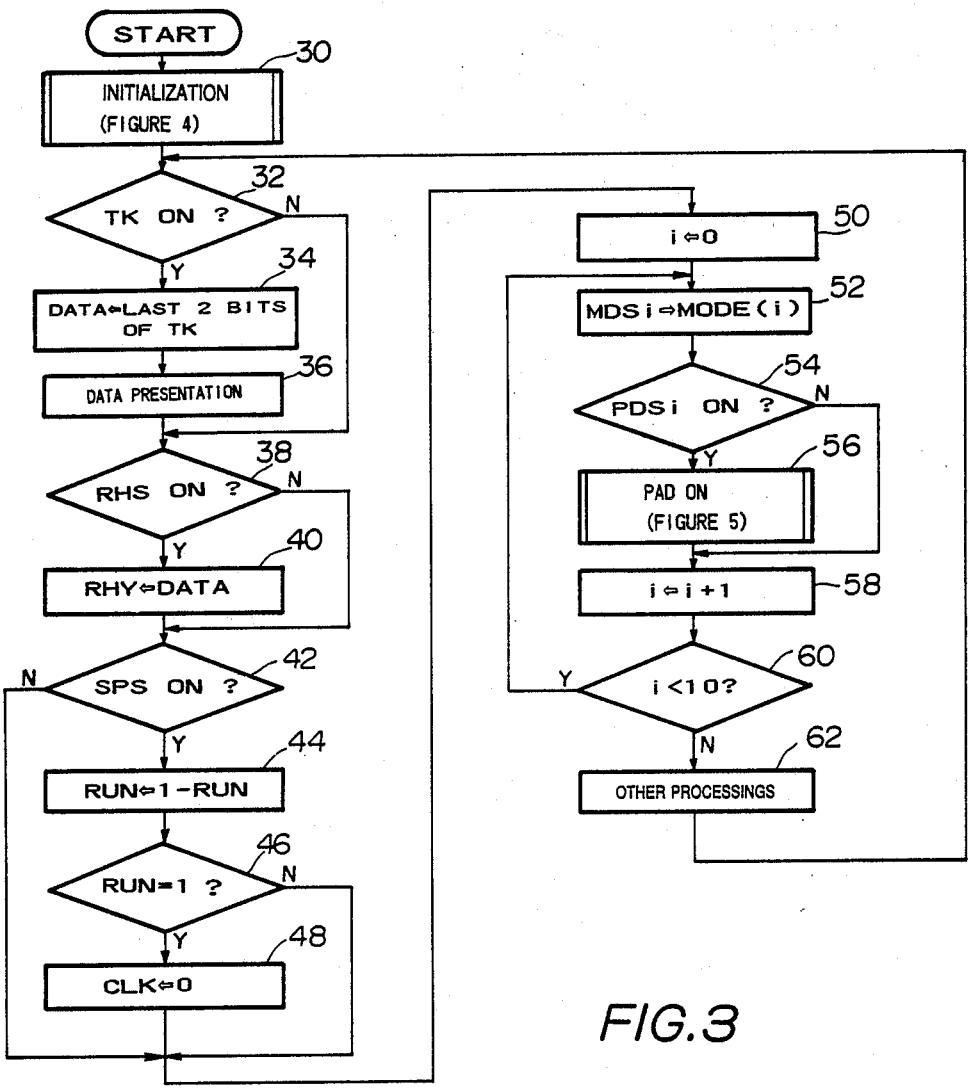
FIG. 3 is a flowchart of the main routine.

FIG. 3 shows the flow of main routine processing, which begins in response to the power being turned on. The subroutine of initialization in Step 30 is discussed in FIG. 4. In Step 32, Numeric Key TK should be checked to determine if any key is in the "ON" state. If any key is in an "ON" state (referred to as "Y"), then proceed to Step 34.

In Step 34, key data, which represents the last two digits of the number designated through Numeric Key TK, are set into Key Data Register DATA.

In Step 36, the value of Key Data Register DATA is displayed on the display DPL.

If, for example, the digits "1", "1", and "2" are selected through Numeric Key TK, the last two digits of "112", that is "12", will be set into Key Data Register DATA and displayed on Display DPL after processing through steps 32 to 36.

The number displayed on DPL (i.e., "12" in this case) is used as a rhythm pattern number which represents the kind of rhythm when Rhythm Selection Switch RHS is on. It is used as the rhythm tone number which represents the tone of a rhythm when Assignment Switch ASS and any desired pad controller are simultaneously on.

When the process of Step 36 is finished or when the result of Step 32 is negative (N), proceed to Step 38 to determine if Rhythm Selection Switch RHS in "ON" or not. If the result is positive (Y), the proceed to Step 40 and set the value of DATA to RHY. The number displayed on DPL as a result of the said processing will be used as a rhythm pattern number.

When the process of Step 40 is completed, or when the result of Step 38 is negative (N), proceed to step 42 to determine if Start/Stop Switch SPS is "ON" or not. If the result is positive (Y), proceed to Step 44.

In Step 44, the remainder of deducting the value of RUN from "1" is set in RUN. Thus, RUN becomes "1" if RUN was originally "0", and RUN becomes "0" if RUN was originally "1".

In Step 46, a check is made to determine whether or not the value of RUN is "1". If the result is positive (Y), proceed to Step 48 and set the Clock Counter CLK to "0". This procedure makes it possible to read out a rhythm pattern at the beginning of a bar and to cause the automatic rhythm to run.

When the process of Step 48 is completed or when the result of Step 42 or 46 is negative (N), proceed to Step 50 and set Control Variable (i) to "0". At Step 52, the mode number designated by Mode Selection Switch MDSi in Mode Register MODE(i) is set.

In Step 54, a check is made to determine whether or not Pad Controller PDSi is in the "ON" state. When the result is positive (Y), proceed to Step 56 and perform the subroutine of pad-on as will be discussed in the description of FIG. 5.

When the process of Step 56 is completed or when the result of Step 54 is negative (N), proceed to Step 58 and increase the value of (i) by 1, then proceed to Step 60.

In Step 60, a check is made to determine whether or not the value of (i) is less than 10. If the result is positive (Y), then return to Step 52. The procedures after Step 52 should be repeated in the same manner as mentioned above until the value of (i) becomes 10.

As a result of this, an appropriate mode number, which corresponds to the state of Mode Selection Switch MDS0 to MDS9 is set successively in the ten modes (0 through 9) of the Register MODE. At the same time, the subroutine of padon is carried out for any switched-on controller of Pad Controller PDS0 through PDS9.

If (i) becomes 10, the result of Step 60 will be negative (N), and the process will proceed to Step 62. In this step, other processing related to tempo, volume, etc., will be performed, followed by a return to Step 32 and a repetition of the steps described above.

Figure 4:
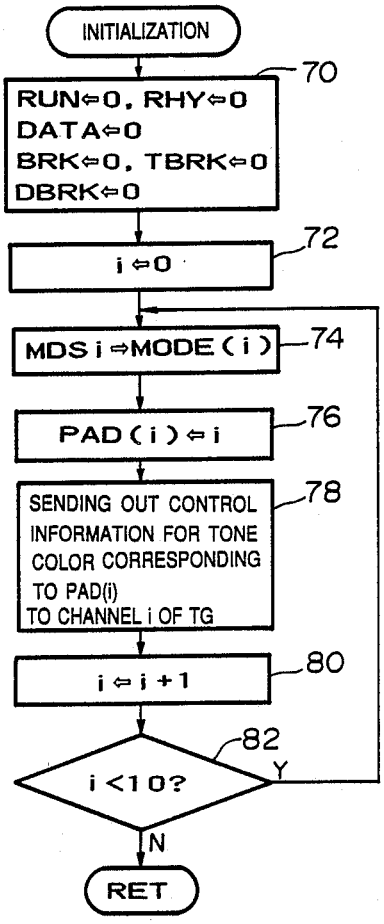
FIG. 4 is a flowchart of the initialization of the sub-routine.

The initialization subroutine of Step 30 discussed in the previous figure is shown in FIG. 4. At the beginning in Step 70, RUN, RHY, DATA, BRK, TBRK, and DBRK are all set at "0".

In Step 74, the mode number, which is related to the selection of MDSi into MODE(i), is set.

In the next step, Step 76, the value of (i) in PAD(i) is set. Read out of the tone control data which responds to the rhythm tone number of PAD (i) from Tone Memory 22 is transferred to Channel (i) of TG 26. In the case in which (i)=0, PAD(0)=0 and the rhythm timbre of number 0 is assigned to Pad Controller PDS0 and Channel 0.

In Step 80, the value of (i) is increased by 1. In the subsequent step 82, a check is made to determine whether or not the value of (i) is less than 10. If the result is positive (Y), then a return to Step 74 is made and the steps following Step 74 are repeated until (i) becomes equal to 10.

The result of this is that an appropriate number, which corresponds to the set state of MDS0-MDS9, is set to the ten MODEs from 0 to 9, respectively. At this time , the rhythm tone numbers from 0 to 9 are set to each of the PADs numbered 0 to 9, respectively. The rhythm tones from 0 to 9 are consequently assigned to each Pad Controller from 0 to 9, as well as to each channel from 0 to 9 in the initial state. The assignment of the rhythm tone can be altered by the processing from Step 90 to 94 as mentioned in the following discussion of FIG. 5.

When the value of (i) becomes 10, the result of performing Step 82 will be negative (N), and this will cause the return to the routine in FIG. 3.

Figure 5:
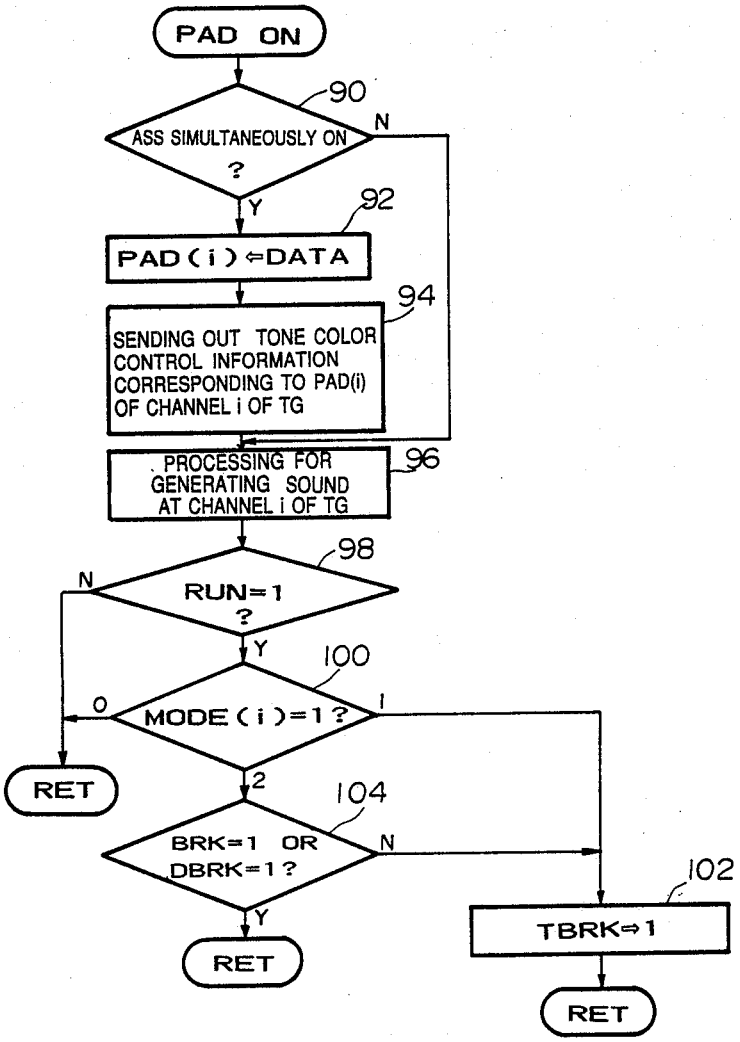
FIG. 5 is a flow chart of the pad-on sub-routine.

The pad-on subroutine is shown in FIG. 5. When any of the pad controllers numbered 0 to 9 is switched on, this subroutine is executed. The designation (i), in the context of the pad-on subroutine, refers to the number of the pad controller 0 through 9 which is switched on.

In Step 90, a check is made to determine whether or not Assignment Switch ASS is "ON". If the result is positive (Y), then proceed to Step 92 and set the value of DATA in PAD(i). The rhythm tone number is displayed on the display DPL, and this is followed by Step 94. In Step 94, the timbre control data, which responds to PAD(i), is transferred to Channel (i) of TG 26 in the same manner as Step 78. The rhythm timbre responding to PAD(i) is assigned to Channel (i).

When Step 94 is completed or when the result of Step 90 is negative (N), proceed to Step 96 and carry out the process of sound production for Channel (i) of TG 26.

The rhythm sound signal is thus generated from Channel (i) in accordance with the timing of switch-on operation of Pad Controller PDSi. The rhythm sound signal has the rhythm tone which is determined by the assignment. In this case, when the result of Step 90 is positive (Y), it means the rhythm sound is generated after the completion of the assignment.

In Step 98, a check is made to determine whether or not the value of RUN is 1 (which indicates the automatic rhythm is running). If the result is positive (Y), proceed to Step 100, but if the result is negative (N), a return is made to the routine in FIG. 3.

As indicated above, it is possible to carry out the routine of FIG. 5 in response to the pad operation even during the period of automatic rhythm performance. The simultaneous performance of automatic and manual rhythm is therefore possible.

In Step 100, a check is made to determine whether or not the value of MODE(i) is "0", "1", or "2". If the value is "0", MODE(i) is in the nominal mode, so there is a return to the routine in FIG. 3. If the value of MODE(i) is "1", this indicates a break in the mode and indicates the progression to Step 102. In this Step 102, TBRK is set at "1" (which indicates that the break is enabled) and a return is made to the routine of FIG. 3. If instead the result of Step 100 is "2", then the break-inhibition mode is activated and the program proceeds to Step 104.

In Step 104, a check of BRK is required. If BRK is "1", which indicates a break, or if DBRK is "1", which indicates no inhibition, then the result is positive (Y) and there is a return to the routine of FIG. 3 without carrying out the break enabling. If, in contrast, the result of Step 104 is negative (N), it means a non-break state or an enabled break state is acceptable. There is then a return to the routine of FIG. 3 after setting TBRK at "1" (indicating a break enabling) at Step 102.

Figure 6:
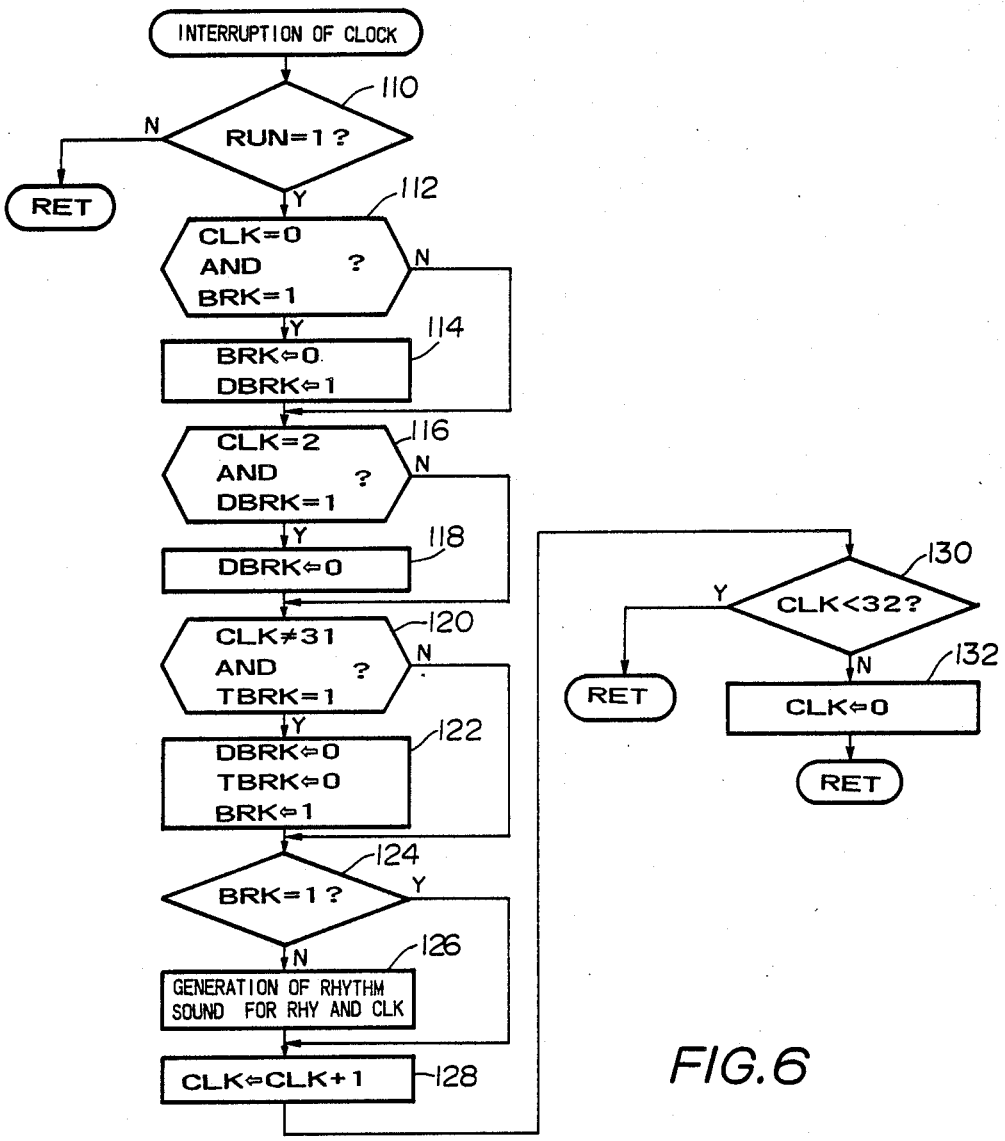
FIG. 6 is a flow chart of the clock-interruption routine.

FIG. 6 shows the clock-interruption routine which is started at every clock pulse of Clock Tempo Signal TCL.

In Step 110, a check is made to determine whether or not RUN is "1". If the result is negative (N), then a return is made to the routine of FIG. 3. If the result is positive (Y), then continue to Step 112 and check if CLK is 1 and BRK is 1, which indicates that the time is nearing the end of the bar. If the result of the check is positive (Y), then proceed to Step 114 and set BRK and DBRK to "0" and "1", respectively. The resumption of the automatic rhythm performance is thus possible and so the break is inhibited during the period "B" in FIG. 2.

When the process of Step 114 is completed or when the result of Step 112 is negative (N), then proceed to Step 116 and check if CLK is "2" and DBRK is "1". If the result is positive (Y), proceed to Step 118 and set DBRK to "0". The break after the period designated as "B" in FIG. 2 is therefore possible.

When the process in Step 118 is completed or when the result of Step 116 is negative (N), then proceed to Step 112 and check if CLK is not "31" and TBRK is "1". If the result of the check is positive (Y), proceed to Step 112 in order to permit a break, set BRK at "1", and set both DBRK and TBRK to "0".

In Step 124, a check is made to determine whether or not BRK is "1". If the result is positive (Y), proceed to Step 128, bypassing the rhythm sound production Step 126, and thus causing a cessation of the automatic rhythm. If, in contrast, the result of Step 120 is negative (N), bypass Step 122 and proceed to Step 124 in order to inhibit a break. In Step 124, if the result is negative (N), proceed to Step 126.

In Step 126, a rhythm pattern is selected corresponding to the rhythm number RHY from Rhythm Pattern Memory 22. If there is any sound which should be produced at the timing of sound production designated by CLK, then the sound production control data is fed to TG 26 and the rhythm sound is generated. After Step 126, the value of CLK is increased by 1 in Step 128.

In Step 130, a check is made to determine if the value of CLK is less than 32. If the result is positive (Y), then the program will return to the routine in FIG. 3. If the result is negative (N), CLK is set at 32 so that the return to the routine of FIG. 3 will be conducted after first setting CLK to "0" in Step 132. In the case where the routine in FIG. 6 has the values CLK=30 and TBRK=1, the result of Step 120 will be positive (Y) and the automatic rhythm will stop due to Steps 122 and 124. If the routine in FIG. 6 instead begins with CLK=31 and TBRK=1, the result of Step 120 will be negative (N) and the rhythm sound can be generated by Step 126. CLK becomes 32 in Step 128, and 0 in Step 130. When the routine of FIG. 6 begins later, the results of Steps 112 and 116 are negative and that of Step 120 is positive. In this case, the break starts from the beginning of the next bar.

Should the result of Step 104 be negative in the routine in FIG. 5, TBRK will never be "1". Regardless of the CLK value at the time when the routine of FIG. 6 begins, the result of Step 120 is thus negative (N), and the transition to a break is inhibited.

Variations of the above-described embodiment will be considered in the following:

(1) Although one pad controller responds to one sound source channel in the example embodiment, it is possible to apply another method of channel assignment in which sound source channels are fewer in number than the installed pad controllers. The rhythm sound responding to the operated pad controller is assigned to any of the channels and the sound is then generated. This method of channel assignment is positively applied not only for the manual rhythm generation but also for the automatic rhythm generation.

(2) The tone control data is designed to be transferred to the sound source channel which responds to a pad controller at the time when the rhythm tone is assigned to the pad controller. It is also possible to transfer the tone control data whenever the pad controller is operated. With this method, it is possible to deal with the said method of channel assignment.

(3) In the example of this invention, the generation of the automatic rhythm is inhibited during a pause. It is also possible to perform the automatic rhythm at a lowered volume, instead of stopping the automatic rhythm completely.

(4) A decrease in volume at the beginning of a bar which follows a pause is also possible. This makes the end of the break more conspicuous.

(5) Any type of rhythm tone can be assigned to a pad controller. However, it is also possible to assign a fixed rhythm pattern to a particular pad controller.

As discussed in the previous sections, the present invention provides a means which allows the generation of manual rhythm to signify the end of a pause, resulting in the resumption of the automatic rhythm without the need for the operator to again select the automatic rhythm.

What is claimed is:

1. An electronic rhythm performing apparatus, comprising:

(a) memory means for storing a rhythm pattern;

(b) automatic rhythm generating means for automatically generating an automatic rhythm signal representing an automatic rhythm performance in accordance with said rhythm pattern;

(c) manual rhythm generating means for generating a manual rhythm signal representing a manual rhythm performance in accordance with a manual operation thereof; and (d) control means for restraining said automatic rhythm signal during a predetermined time interval in response to said manual rhythm performance so that said manual rhythm performance has priority over said automatic rhythm performance for the predetermined time interval.

2. An electronic rhythm performing apparatus according to claim 1, further comprising:

(a) clock means for generating clock signals; and (b) break means for suppressing an automatic rhythm signal during a predetermined time interval according to a clock signal, suppression being triggered by the manual operation of the manual rhythm generating means, whereby a manual rhythm signal is performed during the predetermined time interval, interrupting the automatic rhythm signal.

3. An electronic rhythm performing apparatus according to claim 2 wherein the manual operation of the manual rhythm generating means during the predetermined time interval does not trigger another suppression of the automatic rhythm generating signals.

4. An electronic rhythm performing apparatus according to claim 3 wherein the predetermined time interval ends at the end of the bar in which the manual rhythm generating means is operated.

5. An electronic rhythm performing apparatus according to claim 4 wherein the manual operation of the manual rhythm generating means within a predetermined period after the end of the predetermined time interval does not trigger another suppression of the automatic rhythm generating signal.

6. An electronic rhythm performing apparatus according to claim 4 wherein the predetermined period is one fourth of a predetermined note length.

7. An electronic rhythm performing apparatus according to claim 2 wherein the automatic rhythm signal is not generated during the operation of the manual rhythm generating means.

8. An electronic rhythm performing apparatus, comprising:

(a) clock signal generating means for generating clock signals;

(b) means for designating a desired rhythm pattern;

(c) information generating means for generating musical tone signal control information according to the clock signals and desired rhythm pattern;

(d) operating means for designating generation of musical tone signals;

(e) musical tone generating means for generating an automatic rhythm signal according to the musical tone signal control information and for generating a manual rhythm signal representing a manual rhythm performance according to the operation of the operating means;

(f) break means for breaking the automatic rhythm signal according to the operation of the operating means until a predetermined point of time; and (g) control means for maintaining a break in the automatic rhythm signal for a predetermined period following said predetermined point of time when said operating means is not operated before a second predetermined point of time during said predetermined period and wherein operation of said operating means before said second predetermined point of time during said predetermined period designates a resumption of the automatic rhythm signal.

9. An electronic rhythm performing apparatus according to claim 8 wherein the break means suppresses the automatic rhythm signal until a predetermined point of time.

10. An electronic rhythm performing apparatus according to claim 8, further comprising clock signal counting means for counting an amount of time until said predetermined point of time.

11. An electronic rhythm performing apparatus according to claim 8, wherein said operating means is operated to trigger said break means.

12. An electronic rhythm performing apparatus according to claim 8, wherein triggering of said break means is suspended until said predetermined point of time.

13. An electronic rhythm performing apparatus according to claim 8, wherein said predetermined point of time is the end of a bar.

14. An electronic rhythm performing apparatus according to claim 8, wherein said predetermined period equals one further of a predetermined note length.

* * * * *